US007891525B2

(12) United States Patent
Behar et al.

(10) Patent No.: US 7,891,525 B2
(45) Date of Patent: Feb. 22, 2011

(54) FLUID PRODUCT DISPENSING HEAD

(75) Inventors: Alain Behar, Suresnes (FR); Laurent Decottignies, Cergy (FR)

(73) Assignee: Airlessystems, Charleval (FR)

( * ) Notice: Subject to any disclaimer, the term of this patent is extended or adjusted under 35 U.S.C. 154(b) by 1023 days.

(21) Appl. No.: 10/563,558

(22) PCT Filed: Jul. 6, 2004

(86) PCT No.: PCT/FR2004/001751

§ 371 (c)(1),
(2), (4) Date: Jun. 15, 2006

(87) PCT Pub. No.: WO2005/005281

PCT Pub. Date: Jan. 20, 2005

(65) Prior Publication Data

US 2006/0237488 A1 Oct. 26, 2006

(30) Foreign Application Priority Data

Jul. 8, 2003 (FR) ..... 03 08353

(51) Int. Cl.
*B05B 11/00* (2006.01)

(52) U.S. Cl. ..... 222/153.13; 222/153.11; 222/402.11; 222/402.13; 222/380; 222/383.1; 222/321.7; 222/407; 239/333

(58) Field of Classification Search ..... 222/153.11, 222/153.13, 153.14, 402.11, 402.12, 402.13, 222/402.1, 320, 407, 321.1, 321.7–321.9, 222/153.01, 402.25, 406, 380, 383.1, 402.24; 239/333

See application file for complete search history.

(56) References Cited

U.S. PATENT DOCUMENTS

| | | | | |
|---|---|---|---|---|
| 3,584,789 | A | 6/1971 | Traynor | |
| 4,257,561 | A * | 3/1981 | McKinney | 239/581.2 |
| 7,464,839 | B2 * | 12/2008 | Heukamp | 222/402.13 |
| 2003/0168476 | A1 * | 9/2003 | Sanchez | 222/321.7 |

FOREIGN PATENT DOCUMENTS

| | | | |
|---|---|---|---|
| EP | 0 342 741 | A | 11/1989 |
| EP | 1 310 437 | A | 5/2003 |
| FR | 2 654 079 | A | 5/1991 |
| FR | 2 772 010 | A | 6/1999 |
| WO | WO 04/000066 | * | 12/2003 |

* cited by examiner

*Primary Examiner*—J. Casimer Jacyna
(74) *Attorney, Agent, or Firm*—Sughrue Mion, PLLC

(57) ABSTRACT

A fluid dispenser head having a fluid duct (73, 61) and a dispenser orifice (83) from which the user can draw the dispensed fluid. The head including a closure mechanism for selectively closing the dispenser orifice (83). The closure mechanism has a closure member (93) that is displaceable between a closed position and an open position. The head also includes a non-rotary portion (6) that is prevented from turning relative to the dispenser member (4), and a rotary portion (7, 8) that can be turned relative to the non-rotary portion (6), and a displacement mechanism (69; 69') that displaces the closure member (93; 93') between the closed and open positions while the rotary portion (7, 8) is being turned relative to the non-rotary portion (6).

19 Claims, 5 Drawing Sheets

FLUID PRODUCT DISPENSING HEAD

FIELD OF THE INVENTION

The present invention relates to a fluid, liquid, or powder dispenser, and more particularly to a fluid dispenser head forming an integral part of a fluid dispenser. The head can have a pushbutton integrated therein, on which the user can press so as to actuate the dispenser. In a variant, the dispenser head can be dissociated from the actuator pushbutton. Such a dispenser fitted with such a dispenser head finds an advantageous application in the fields of cosmetics, pharmacy, or even perfumery.

The dispenser head is for co-operating directly or indirectly with a dispenser member, such as a pump mounted on a fluid reservoir formed by a receptacle. The head generally comprises a fluid duct defining an inlet end and an outlet end, the inlet end being connected to an outlet of the pump, and the outlet end of the duct defining a dispenser orifice from which the user can draw the dispensed fluid. The present invention applies particularly to heads further comprising closure means for selectively closing the dispenser orifice, so as to protect the fluid contained inside the fluid duct. This makes it possible to avoid any deterioration of the fluid resulting from oxidization or drying out. In general, the closure means comprise a closure member that is displaceable between a closed position in which the closure member closes the dispenser orifice, and an open position in which the fluid coming from the dispenser member can flow through the duct and the dispenser orifice.

BACKGROUND

Numerous types of closure means making it possible to close the dispenser orifice of a dispenser head already exist in the prior art. The various closure means differ from one another in the method of displacing the closure member relative to the dispenser orifice to be closed. A first type of closure means implements closure members that can be displaced by the fluid under pressure. Thus, while the dispenser is being actuated, the fluid forced out under pressure acts directly or indirectly on the closure member so as to displace it from its closed position, and thus provide an outlet passage for the fluid under pressure. In addition, there exists another type of closure means having a closure member that can be displaced by manipulating it prior to actuating the dispenser. The present invention applies more particularly to this second type of closure means that can be actuated independently of the dispenser being actuated. Such closure means are already known in the prior art. Very simple closure means are constituted by closure means in which the closure member closes the dispenser orifice from the outside. In this event, the user must remove the closure member from the dispenser orifice by acting directly or indirectly on the closure member. In addition, there exist closure means having a closure member that acts from the inside of the dispenser head. In this event, the user must act on actuator means that make it possible to displace the closure member inside the dispenser head. In general, the actuator means cause the closure member to be displaced in translation.

CERTAIN OBJECTS OF THE INVENTION

An object of the present invention is to define another type of actuator method for a closure member forming an integral part of the closure means integrated in a dispenser head of a fluid dispenser.

To do this, the present invention proposes that the head further comprises a non-rotary portion that is prevented from turning relative to the dispenser member, and a rotary portion that can be turned relative to the non-rotary portion, said head further comprising displacement means that are capable of displacing the closure member between the closed and open positions while the rotary portion is being turned relative to the non-rotary portion. The closure means are preferably housed inside the rotary portion of the head. Thus, the closure member is not only turned by the rotary portion, but it is also displaced in translation inside the rotary portion between the closed and open positions. Thus, the closure member performs a movement that is complex and similar to a segment of a concentric spiral.

The displacement means are advantageously formed by the non-rotary portion. In addition, the dispenser orifice may be formed by the rotary portion.

In an aspect of the invention, the duct is formed in part by the rotary portion, and is formed in part by the non-rotary portion. Advantageously, the duct comprises a radial section formed by the rotary portion and an axial section formed by the non-rotary portion, the axial section being connected to the radial section. The closure means are preferably housed in the radial section. In addition, the displacement means may extend into the radial section. In a variant, the duct may be formed entirely by the rotary portion. In any event, the closure means, and more particularly the closure member, is housed inside the duct formed by the rotary portion.

According to another advantageous characteristic of the invention, the rotary portion defines an axis of rotation, the displacement means being off-center relative to said axis.

In another aspect, the closure means comprise a connection element, and an anchor element, said connection element connecting the closure member to the anchor element. The displacement means are advantageously engaged with the anchor element, so as to exert traction on the closure member by means of the connection element. In a variant, the displacement means are engaged with the connection element, so as to cause the connection element to deform.

In yet another aspect, the connection element urges the closure member into leaktight contact in the dispenser orifice, in the closed position.

According to another advantageous characteristic of the invention, the fluid dispenser head further comprises a pushbutton on which the user presses in order to actuate the dispenser member, and a rotary locking system that is displaceable between a locked position in which the head does not operate when the pushbutton is pressed, and an unlocked position in which the head does operate when the pushbutton is pressed, the locked and closed positions coinciding, and the unlocked and open positions coinciding. Thus, the user does not even notice the presence or the action of the closure means whose actuation coincides with the actuation of the rotary locking system. It should be noted that such a rotary locking system is already known in the prior art, and in particular from document FR-2 789 057. The advantage of associating the closure means of the invention with such a locking system resides in the fact that the actuation of the locking system leads automatically to actuation of the closure means, without any need for an additional operation.

The invention also provides a fluid dispenser comprising a fluid reservoir, a dispenser member such as a pump, and a dispenser head as defined above.

BRIEF DESCRIPTION OF THE DRAWINGS

The invention is described more fully below with reference to the accompanying drawings which show two embodiments of the invention by way of non-limiting example.

In the figures.

DETAILED DESCRIPTION OF NON-LIMITING EXEMPLARY EMBODIMENTS OF THE INVENTION

Figure 1:
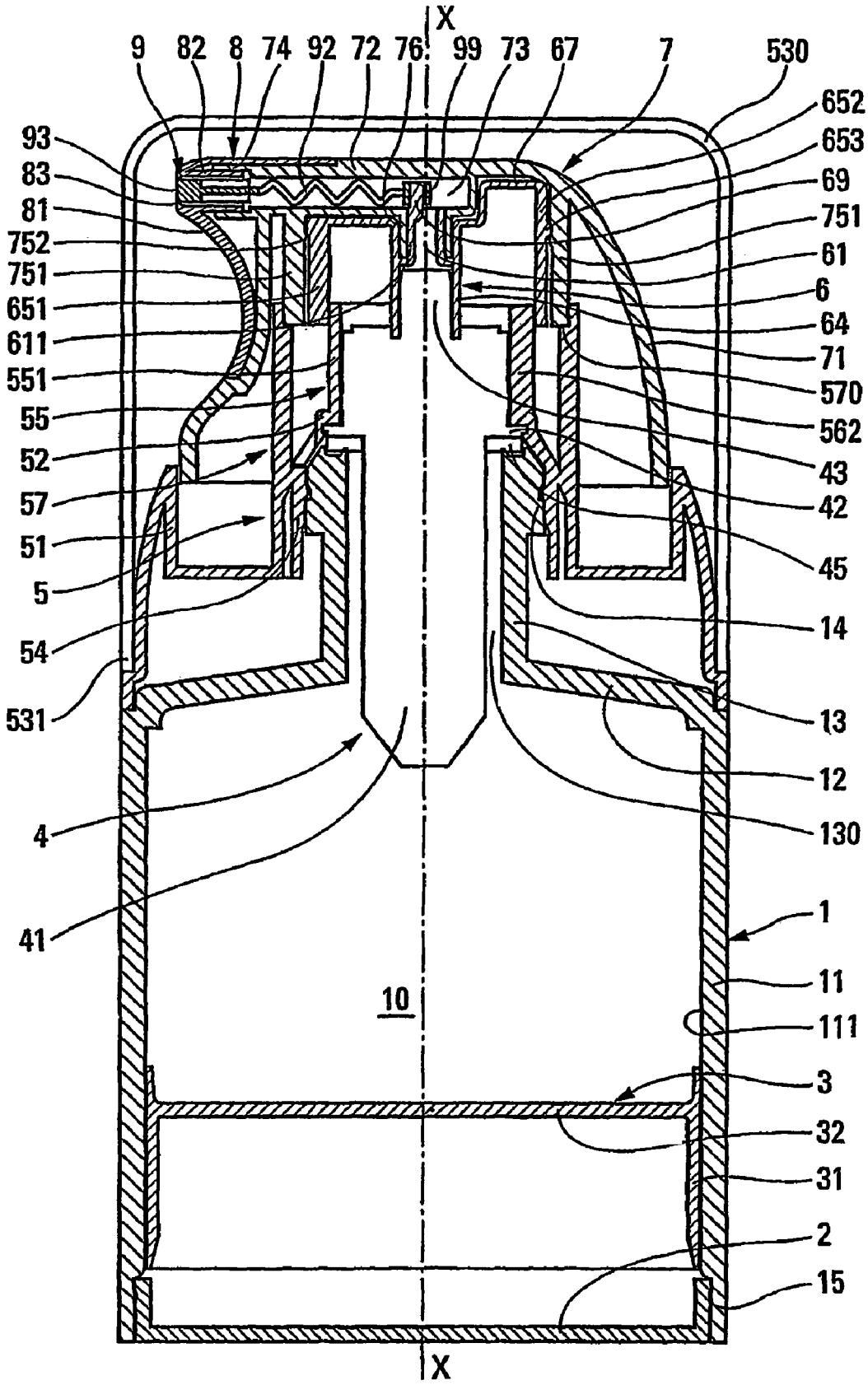
FIG. 1 is a vertical section view through a fluid dispenser constituting a first embodiment of the invention.

Reference is made firstly to FIG. 1 in order to describe in detail the various component elements of the fluid dispenser constituting the first embodiment of the invention. However, the second embodiment in FIGS. 7 and 8 differs from the embodiment in FIG. 1 practically only in the closure means and in the displacement means for displacing the closure means. All the other component elements can be identical.

The dispenser includes a receptacle 1 defining a cylinder 11 having an inner sliding-contact wall 111. At its top end, the cylinder 11 is extended by a shoulder 12 that extends inwards. On its inner periphery, the shoulder 12 is connected to a neck 13 internally defining an opening 130. The top end of the neck 13 is provided with reinforcement defining a fastener profile 14 that can be a snap-fastener profile. At its bottom end, the cylinder 11 also defines a reception profile 15 for receiving a separate bottom 2. A follower-piston 3 is slidably mounted inside the cylinder 11. The follower-piston 3 comprises an end wall 32 that is bordered by a sealing lip 31 for being displaced in sliding contact against the inner wall 111 defined by the cylinder 11. The end wall 32, the cylinder 11, the shoulder 12, and the neck 13 together define an internal volume that serves as a fluid reservoir 10. The reservoir is a reservoir of volume that is variable given that the follower-piston 3 is going to be displaced in the cylinder 11 towards the opening 130 as the fluid is extracted from the reservoir. This is one particular kind of reservoir, but it should be understood that other kinds of reservoir of constant or variable volume can be used to implement the present invention. A flexible pouch constitutes another type of variable-volume reservoir. In contrast, a non-deformable rigid flask constitutes a reservoir of constant volume.

The dispenser also includes a dispenser member 4 which, in this embodiment, is a pump. The pump 4 includes a pump body 41 defining a collar 45 that projects radially outwards. The collar comes to bear against the top end of the neck 13, with a neck gasket 45 optionally being interposed therebetween. The pump 4 also includes an actuator rod 43 that is axially displaceable, downwards and upwards, inside the pump body 41. In this embodiment, the actuator rod 43 defines an internal flow channel that enables fluid that is put under pressure inside the pump to be forced out through the channel while the actuator rod 43 is being pushed into the pump body 41. The pump 4 is disposed on the receptacle 1 with its collar 45 bearing against the top edge of the neck 13, so that the main portion of its body 41 extends inside the opening 130 of the neck 13, with its actuator rod 43 projecting out of the neck 13.

The dispenser member 4 presents an axis of circular symmetry XX that is the axis of the dispenser as a whole. Preferably, the receptacle 1 also presents an axis of circular symmetry that coincides with the axis XX once the dispenser member 4 is mounted on the neck 13 of the receptacle.

The dispenser also includes a fastener member 5 whose first function is to fasten the dispenser member 4 onto the receptacle 1. The fastener member 5 includes a reception housing 52 for the collar 42 of the pump 4: the collar 42 is preferably held by snap-fastening in the housing 52. The fastener member 5 also includes a fastener skirt 54 that is engaged, advantageously by snap-fastening, with the fastener profile 14 formed by the neck 13. The combination of the housing 52 and of the skirt 54 enables the pump 4 to be fastened in stable manner in the opening 130 of the neck 13. The fastener member 5 can also include a dome 51 that becomes engaged via its outer periphery with the shoulder 12 of the receptacle 1. The fastener member 5 also forms an axial guide bushing 56 that extends around the top portion of the pump body 41. The outside of the guide bushing 56 is formed with a series of splines and grooves 561 that extend longitudinally and vertically. The fastener member 5 also includes a locking sleeve 57 having an inside wall which, in this embodiment, forms two grooves 571, as can be seen in figures. The locking sleeve 57 also forms two shoulders 570 in the proximity of its free top end. The shoulders 570 are directed inwards and communicate at one of their ends with the grooves 571. The thickness of the wall of the sleeve above the shoulder 570 is small.

In this embodiment, the fluid dispenser head of the invention comprises four component parts, namely an insert 6, a body 7, a nozzle 8, and closure means 9. The fastener member 5 can be considered as forming an integral part of the dispenser head, since it co-operates with the head in order to fulfill certain functions, as described below.

The insert 6 includes a connection sleeve 64 inside which the free top end of the actuator rod 43 is engaged. The connection sleeve 64 is extended by a tube 611 that internally defines an axial duct section 61. The section 61 thus extends upwards in register with the internal channel defined inside the actuator rod 43. Consequently, the fluid coming from the actuator rod 43 can flow into the duct section 61. The tube 611 is also provided with a lug 69 that projects beyond the axial duct section 61. As described below, it can be seen that the lug 69 functions as means for displacing the closure means 9. As described below with reference to FIGS. 4 and 5, it can also be seen that the lug can operate in a different way in order to displace the closure means 9'. The insert 6 also defines an annular flange 67 that extends outwards from the top end of the connection sleeve 64. The flange 67 is extended over its outer periphery by a guide skirt 65 that extends downwards. On its outside wall, the guide skirt 65 presents snap-fastener means 653 that can be in the form of a continuous snap-fastener bead or a plurality of discontinuous snap-fastener profiles. The guide skirt 65 also forms a series of splines 652 and grooves 651 that extend longitudinally and vertically on its inside wall. The series of splines and grooves is engaged with the complementary series of grooves 561 and splines 562 formed by the guide bushing 56 of the fastener member 5. More precisely, the guide skirt 65 extends concentrically around the guide bushing 56, with the grooves of one interfitted in the splines of the other, and vice versa. The engagement of the grooves and the splines of the skirt and the bushing enables the insert 6 to be displaced axially relative to the fastener member 5, while preventing it from turning relative to said fastener member. Thus, by pressing on the insert 6, the actuator rod 43 is displaced axially into the pump body 41, thereby lowering the guide skirt 65 around the guide bushing 56. The interfitting of the grooves and splines of the bushing and the skirt thus acts as means for preventing turning, and means for providing guidance in axial translation along the axis XX. The insert 6 thus constitutes a non-rotary portion of the dispenser head that does not turn relative to the fastener member 5, the receptacle 1, and/or the dispenser member 4. Naturally, the adjective "non-rotary" should be understood as preventing the insert 6 from turning, while allowing it to be displaced axially.

Figure 3A:
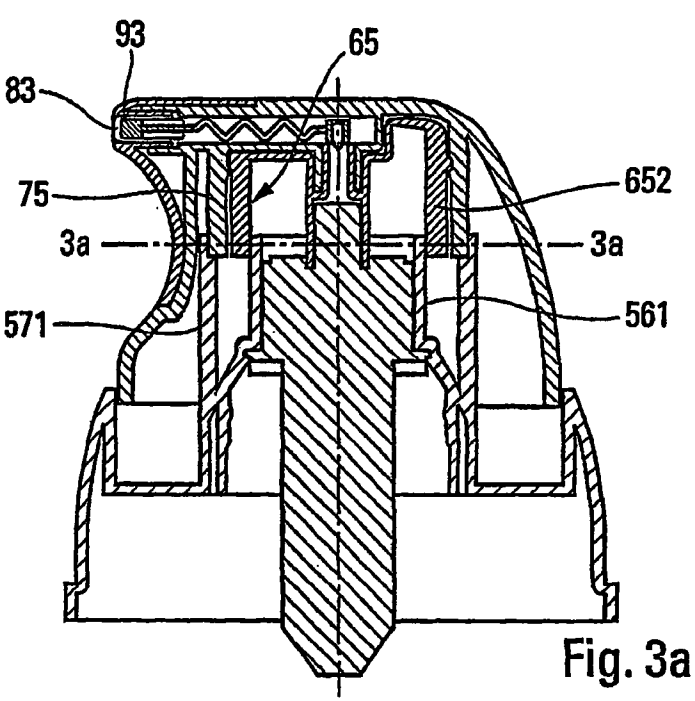
FIGS. 2*a* and 3*a* are views of the FIG. 1 dispenser showing the dispenser in the locked and actuatable positions respectively.
Figure 3B:
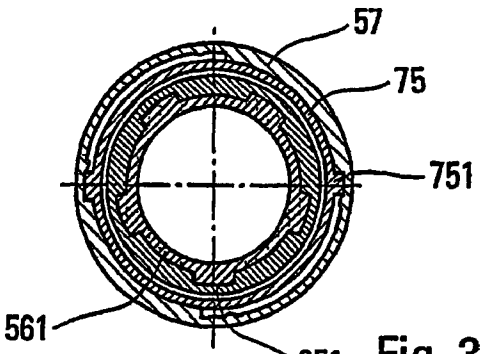
FIGS. 2*b* and 3*b* are section views on section lines 2*a*-2*a* and 3*a*-3*a* in FIGS. 2*a* and 3*a*, respectively.
Figure 2A:
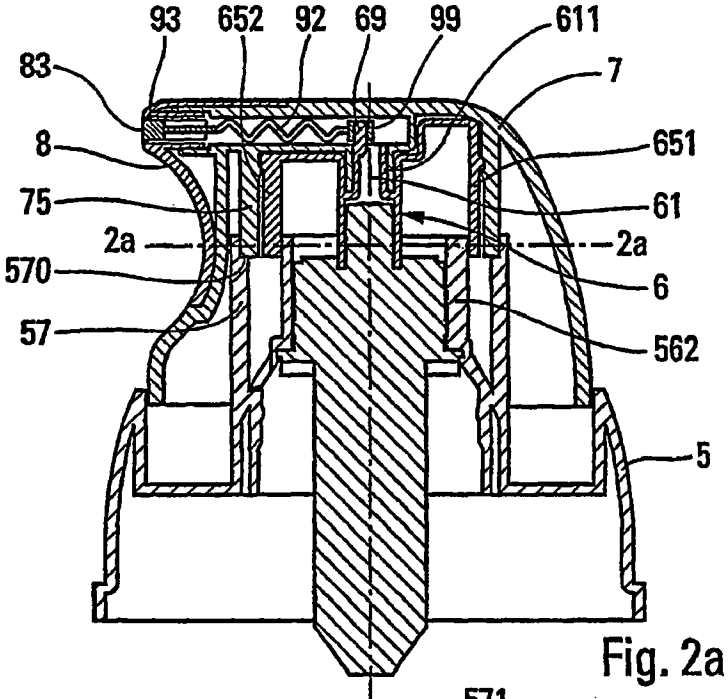
Figure 2B:
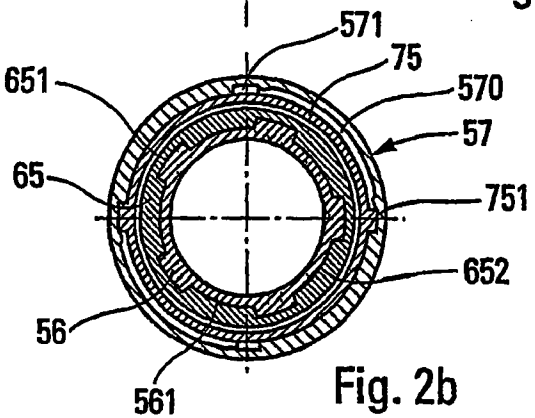
Figure 4A:
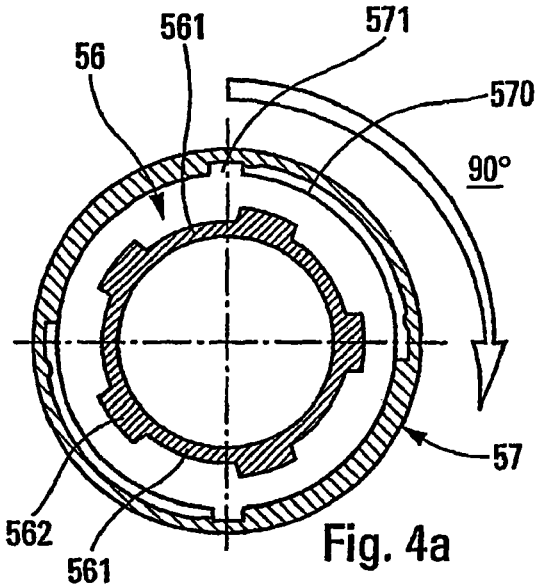
FIGS. 4*a*, 4*b*, and 4*c* are section views of the various elements on section line 2*a*-2*a;*
Figure 5A:
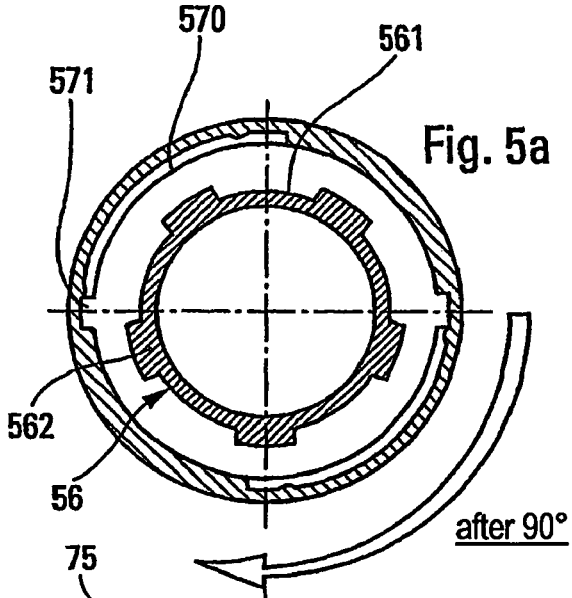
FIGS. 5*a*, 5*b*, and 5*c* are section views of the various elements on section line 3*a*-3*a;*
Figure 4B:
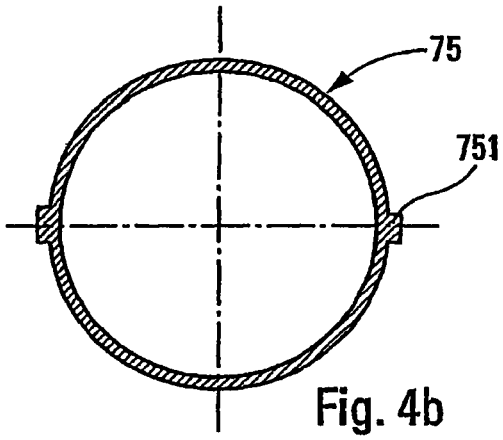
Figure 5B:
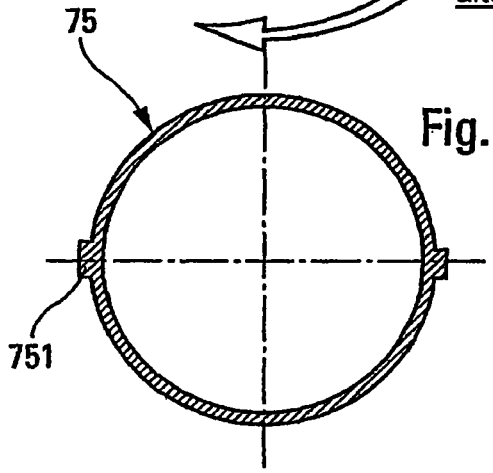
Figure 4C:
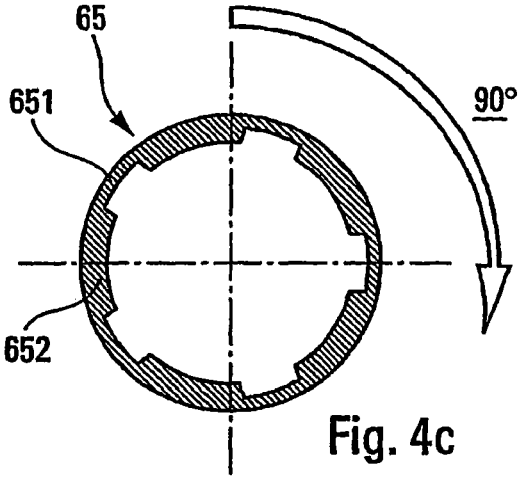
Figure 5C:
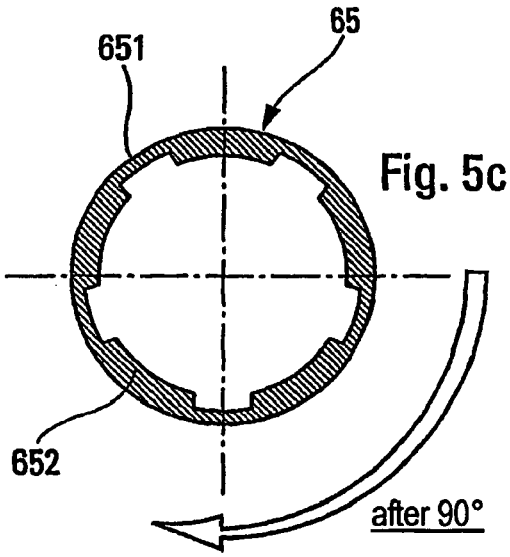

The outside of the body 7 defines a casing 71 and a top pushbutton surface 72. The body 7 also defines an endpiece 74 into which a radial duct section 73 extends. The section 73 extends below the pushbutton surface 72. The radial section 73 opens out downwards, both axially and centrally, at a sleeve 76 that is in rotary leaktight engagement around the tube 611. Thus, the axial duct section 61 is situated inside the sleeve 76, and the axial section 61 communicates directly with the radial section 73. As a result, the fluid coming from the actuator rod 43 can flow through the axial section 61, into the radial section 73. The lug 69 extends into the radial section 73. It should be observed that the lug 69 is off-center relative to the axis XX. This can be seen clearly in FIG. 1. The body 7 also defines a locking skirt 75 that extends downwards. On its inside wall, the skirt 75 defines a fastener profile 752 that preferably acts by snap-fastening with the corresponding profile 653 formed by the guide skirt 65. The profile 752 is engaged below the profile 653 so as to hold the insert 6 inside the locking skirt 75. However, the insert 6 can turn freely inside the locking skirt 75. On its outside wall, the locking skirt is further provided with two vertical splines 751. In FIGS. 1 and 2*a*, the free bottom ends of the splines are in abutment against the shoulder 570 formed at the inside top end of the locking sleeve 57. As a result, it is not possible to displace the body 7 axially relative to the fastener member 5 by pressing on the pushbutton surface 72. In contrast, it is possible to turn the body 7 about the axis XX, leaving the insert 6 and the fastener member 5 unable to turn. The body 7 can thus be turned through one fourth of a turn, for example. While turning in this limited way, the bottom ends of the splines slide over the respective shoulders. FIG. 3*a* shows the dispenser after it has turned through one fourth of a turn. It can thus be seen that the splines formed on the outside of the locking skirt 75 are situated in register with the grooves 571 formed in the inside wall of the locking sleeve 57. The locking skirt 75 can thus be displaced downwards inside the locking sleeve 57. The co-operation of the sleeve 57 with the skirt 75 constitutes a rotary locking system or means that are displaceable between a locked position and an unlocked position. In the locked position, as shown in FIGS. 1 and 2*a*, the body 7 cannot be displaced axially by pressing on the pushbutton surface 72, whereas in the unlocked position shown in FIG. 3*a*, pressing on the pushbutton surface 72 has the effect of lowering the body 7, entraining the insert 6 and the actuator rod 43 into the pump body 41. FIGS. 4*a*, 4*b* and 4*c*, together with FIG. 2*b*, can help in understanding the mutual positions of the various elements in the locked position. Consequently, in the unlocked position shown in FIG. 3*a*, the pump 4 can be actuated. FIGS. 5*a*, 5*b* and 5*c*, together with FIG. 3*b*, can help in understanding the mutual positions of the various elements in this actuatable position. The locking system constituted by the sleeve and the locking skirt constitutes merely one non-limiting example of locking means. Naturally, it is possible to use any other rotary locking system within the ambit of the present invention, without that limiting its scope.

The nozzle 8 includes an outer casing 81 that is engaged with the outer casing 71 and with the pushbutton surface 72 of the body 7. The nozzle 8 also includes a dispenser tube 82 that is engaged in leaktight manner inside the endpiece 74. The tube 82 extends inside the casing 81, and both open out to a dispenser orifice 83. The tube 82 thus co-operates with the dispenser orifice 83 to define a fraction of the radial duct section 73, with said dispenser orifice 83 defining the outlet end of the section 73. At its opposite end, the axial section 61 forms the inlet to the duct. The fluid forced through the actuator rod 43 can thus flow through the section 61, the section 73, and the dispenser orifice 83 from where it can be recovered by the user. The fluid can be dispensed in spray form or even in the form of a bead of fluid.

In the figures, the closure means 9 comprise a closure member 93 that is engaged in the tube 82 so as to make it possible to close said tube at the dispenser orifice 83. This is the situation in FIG. 1. The closure means 9 also comprise an anchor ring 99 that is engaged around the lug 69. The closure member 93 is connected to the anchor ring 99 by means of a connection element 92, which, in this embodiment, presents a certain amount of elastic resilience. The closure means 9 are disposed completely within the radial duct section 73. Only the end front wall of the closure member 93 faces outwards. FIG. 1 shows the dispenser in the rest position, i.e. with the closure member 93 in leaktight engagement in the dispenser orifice 83. It should be observed that the lug 69 is situated to the left of the axis of symmetry XX. The resilient connection element 92 can advantageously assist in urging the closure member 93 into leaktight contact in the dispenser orifice 83. By turning the body 7, while keeping the receptacle stationary, the dispenser orifice 83 is moved through an arc of a circle of constant radius. However, the anchor ring 99 engaged around the lug 69 does not move as a result of the lug 69 forming an integral part of the insert 6 that is prevented from turning relative to the fastener member 5, that is itself prevented from turning relative to the receptacle 1. Given that the lug 69 extends in offset manner relative to the axis XX, its distance relative to the dispenser orifice 83 varies while the body 7 is being turned relative to the insert 6. In FIG. 1, the lug 69 is positioned to the left of the axis XX, so that the distance between the lug and the dispenser orifice 83 is at a minimum. In contrast, after turning through one fourth of a turn, for example, the lug 69 can be positioned at the same level as the axis XX, but without being situated on the axis XX. This is shown in FIG. 3*a*. Thus, the distance between the lug 69 and the dispenser orifice 83 has increased. This has the effect of exerting traction on the closure member 93 that is connected to the anchor ring 99 by means of the connection element 92. Consequently, the closure member 93 is removed from the dispenser orifice 83 by being displaced inside the tube 82. A passage is thus released around the closure member 93 for the fluid that is forced out from the actuator rod, and through the axial section 61 and the radial section 73. FIG. 3*a* thus corresponds to the open position of the closure means, which also corresponds to the unlocked position of the locking system. Conversely, in symmetrical manner, FIG. 1 corresponds to the locked position of the locking system and to the closed position of the closure means. From the FIG. 3*a* position, the user can press on the pushbutton surface 72 so as to actuate the pump 4. The locking skirt 75 can be engaged in the locking sleeve 57, while the guide skirt 65 is engaged around the guide bushing 56.

The body 7, the nozzle 8, and to a certain extent the closure means 9, together constitute a rotary portion that turns relative to the insert 6 that constitutes a portion that does not turn.

It is quite possible to implement the closure system by turning the body 7 independently of the locking system. However, associating the two systems is preferable, given that the actuation of one is directly associated with the actuation of the other. To the user, the closure system of the invention is completely invisible or transparent.

Figure 6:
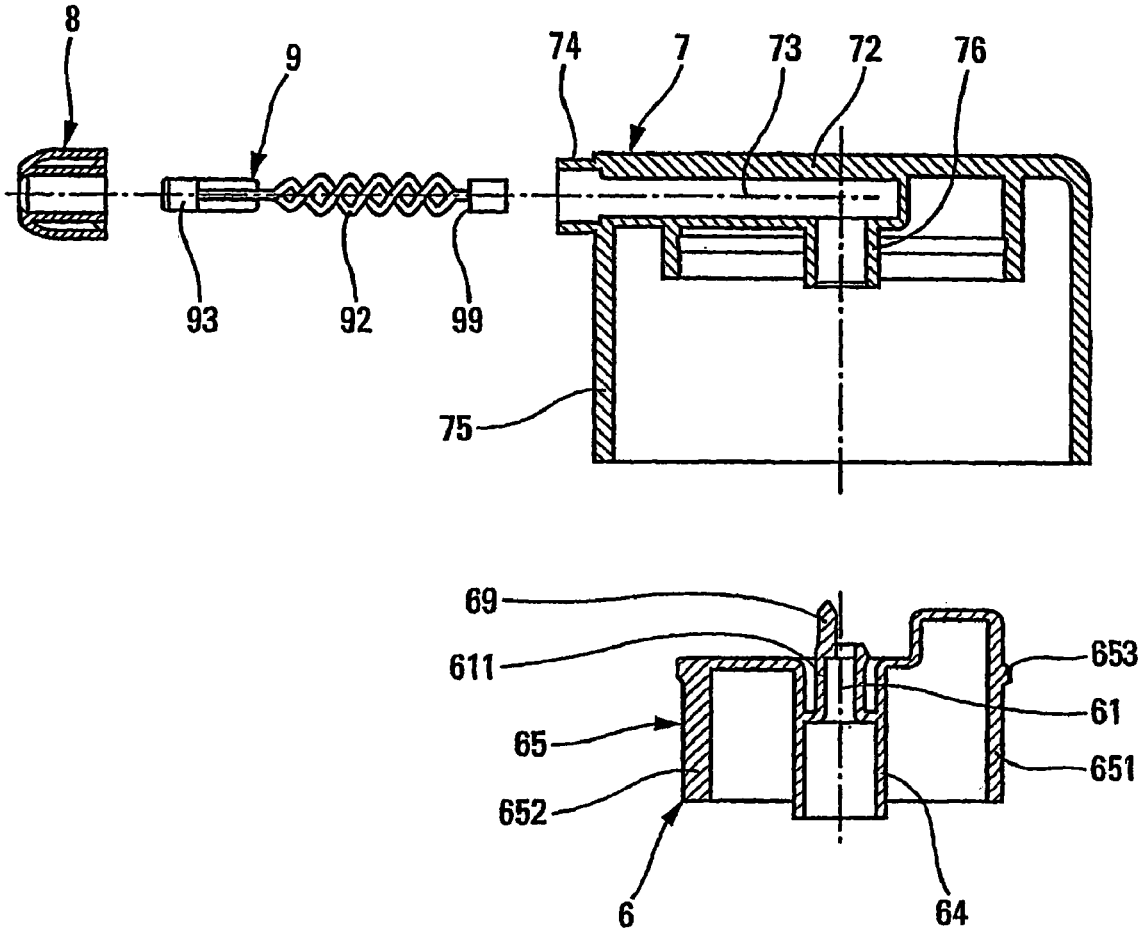
FIG. 6 is an exploded vertical section view of a variant of the FIG. 1 dispenser head.

FIG. 6 shows a dispenser head of the invention which constitutes a variant very close to the FIG. 1 dispenser head. Only the shapes of the body 7 and of the nozzle 8 are different. The exploded view makes it possible to understand the sequence of assembling the various component elements of the head. Firstly, the closure means 9 are engaged inside the radial duct section 73 of the body 7 via the endpiece 74. The closure means 9 are inserted until the anchor ring 99 is positioned in register with the tube 76. Then, the insert 6 can be fitted inside the body 7 by causing the displacement lug 69 to penetrate through the tube 76, so as to become inserted in the anchor ring 99. At this point, the valve member 9 is blocked inside the section 73. It thus suffices to fit the nozzle 8 onto the endpiece 74. The head is thus in its final assembled state.

Figure 8:
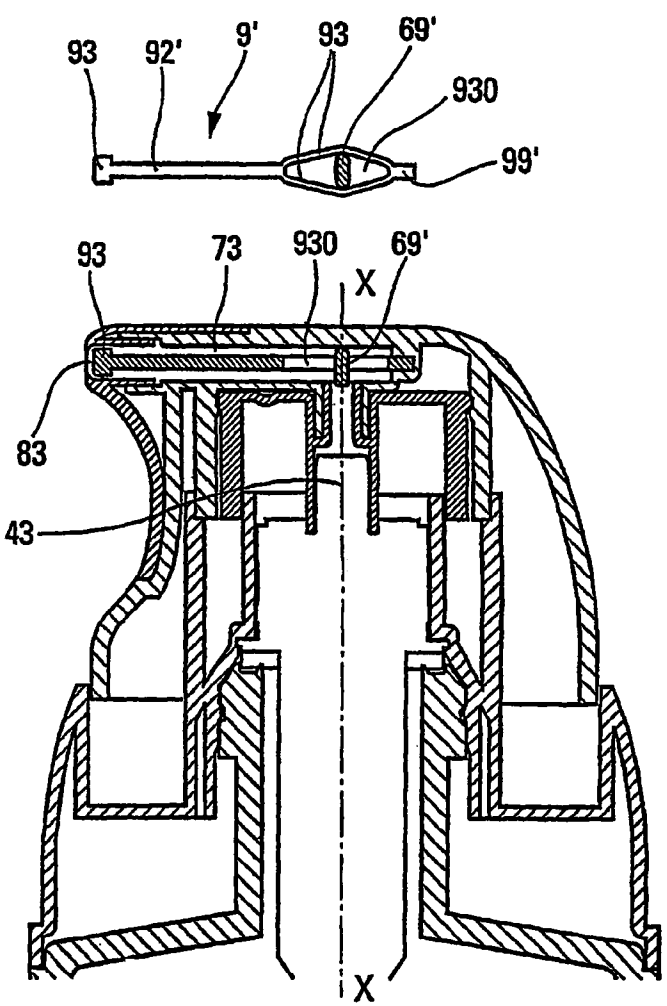
FIGS. 7 and 8 are vertical section views through the top portion of a fluid dispenser constituting another embodiment of the invention, in the locked rest position and the unlocked actuatable position, respectively.
Figure 7:
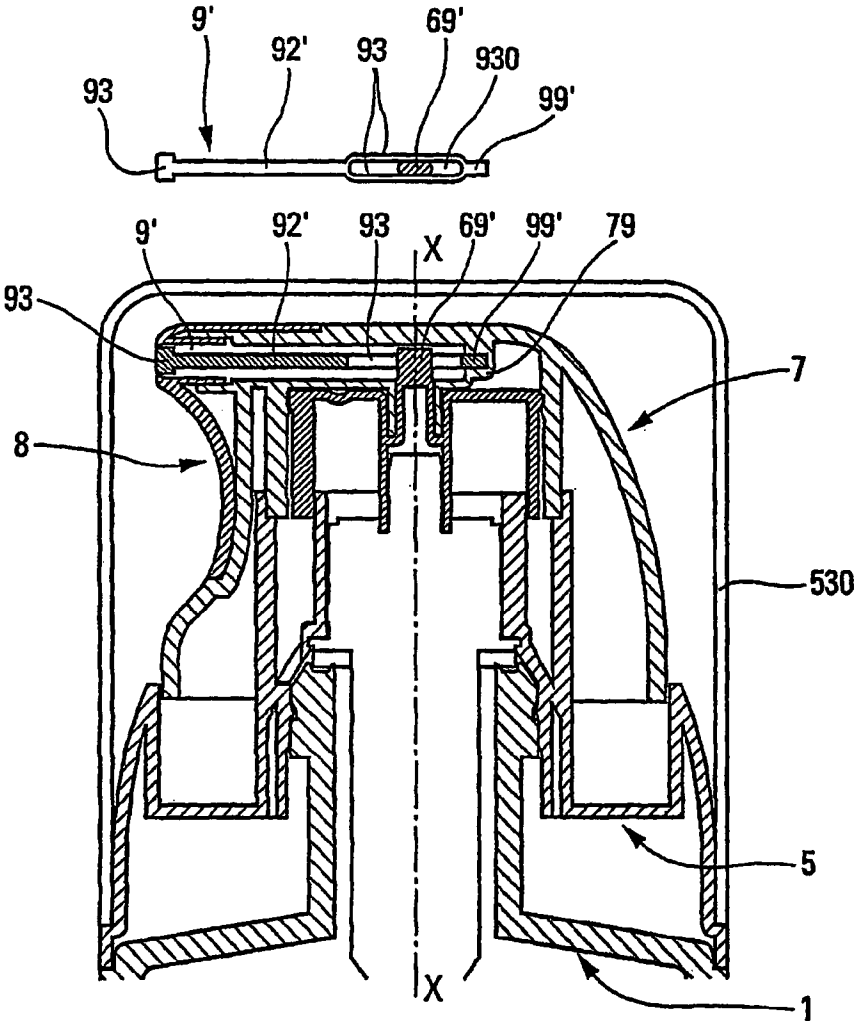

Reference is made below to FIGS. 7 and 8 in order to explain a second embodiment that differs from the preceding embodiment mainly with regard to the closure means and its displacement means. The rest of the dispenser head and even the dispenser can be completely identical to those of the first embodiment in FIG. 1. The closure means 9' of this embodiment comprise a closure member 93 that can be identical to the closure member of the preceding embodiment. The closure means 9' comprise an anchor element that can be in the form of an anchor stub 99' that is engaged in a housing 79 formed by the body 7. The closure means 9' also comprise a connection element formed by a rod 92' and by two strips 93 that interconnect the rod 92' and the anchor stub 99', and that define a window 930 between them. This can be seen in FIG. 7. In addition, the insert 6 forms a displacement lug 69' in the form of a blade 69' that is inserted into the window 930 between the strips 93. The blade 69' presents a narrow dimension and a long dimension. In the closed position shown in FIG. 7, the blade 69' is disposed in the window 930 with its long dimension extending along the longitudinal axis of the closure means 9'. In other words, the blade 69' does not stress the strips 93. The blade 69' can be disposed in completely axial manner along the axis XX. After turning through one fourth of a turn, for example, the unlocked open position in FIG. 8 is reached. The closure means 9' have been turned through one fourth of a turn, without moving the blade 69'. This causes the blade to be displaced inside the window 930, such that its long dimension then extends perpendicularly to the longitudinal direction of the closure means 9'. The blade 69' thus stresses the strips 93 which move apart from each other, thereby increasing the dimension of the window 930. This causes the closure member 93 to move closer to the anchor stub 99'. Given that the stub is securely received in the housing 79, the closure member 93 is retracted inside the duct section 73, in such a manner as to release the dispenser orifice 83. The fluid coming from the actuator rod 43 can thus flow through the duct 73 and the dispenser orifice 83.

In both of the above-described embodiments, the closure means are actuated by the body 7 turning, which constitutes a rotary portion of the dispenser head. In addition, the head includes an insert 6 that is mounted on the dispenser member 4, said insert being unable to turn, but being free to move in axial translation. It should also be observed that the closure member 93 turns with the rotary portion of the dispenser head.

The invention claimed is:

1. A fluid dispenser head for co-operating with a dispenser member (4) mounted on a fluid reservoir (10), said head axially displaceable along an axis XX, said head comprising a fluid duct (73, 61) defining an inlet end (61) and an outlet end (83), said inlet end (61) connected to an outlet (43) of the dispenser member (4) through a connection sleeve 64 that extends axially along the axis XX, and said outlet end defining a dispenser orifice (83) from which the user draws the dispensed fluid, said head further comprising closure means (9; 9') for selectively closing the dispenser orifice (83), said closure means comprising a closure member (93) that is displaceable between a closed position in which the closure member closes the dispenser orifice in a plane at the outlet end containing the dispensing orifice so as to physically plug the outlet end, and an open position in which the fluid coming from the dispenser member can flow through the duct and the dispenser orifice, wherein the head comprises a non-rotary portion (6) that is prevented from turning relative to the dispenser member (4), and a rotary portion (7, 8) that can be turned around the non-rotary portion (6) about the axis XX, said head further comprising displacement means (69; 69') for displacing the closure member (93; 93') between the closed and open positions while the rotary portion (7, 8) is turned relative to the non-rotary portion (6); and wherein the dispenser orifice is formed by the rotary portion.

2. A fluid dispenser head according to claim 1, in which the displacement means (69; 69') are formed by the non-rotary portion (6).

3. A fluid dispenser head according to claim 1, in which the duct (73; 61) is formed in part by the rotary portion, and is formed in part by the non-rotary portion.

4. A fluid dispenser head according to claim 3, in which the duct comprises a radial section (73) formed by the rotary portion and an axial section (61) formed by the non-rotary portion, the axial section connected to the radial section.

5. A fluid dispenser head according to claim 4, in which the closure means (9; 9') are housed in the radial section (73).

6. A fluid dispenser head according to claim 4, in which the displacement means (69; 69') extend into the radial section (73).

7. A fluid dispenser head according to claim 1, in which the rotary portion defines an axis of rotation (XX), the displacement means (69) off-center relative to said axis.

8. A fluid dispenser head according to claim 1, in which the closure means (9; 9') comprise a connection element (92; 92', 93), and an anchor element (99; 99'), said connection element connecting the closure member (93) to the anchor element.

9. A fluid dispenser head according to claim 8, in which the displacement means (69) are engaged with the anchor element (99), so as to exert traction on the closure member by means of the connection element (92).

10. A fluid dispenser head according to claim 8, in which the displacement means (69') are engaged with the connection element (93), so as to cause the connection element to deform.

11. A fluid dispenser head according to claim 8, in which the connection element (92) urges the closure member (93) into leaktight contact in the dispenser orifice (83), in the closed position.

12. A fluid dispenser head according to claim 1, further comprising a pushbutton (73) on which the user presses in order to actuate the dispenser member, and a rotary locking system (57, 75) that is displaceable between a locked position in which the head does not operate when the pushbutton is pressed, and an unlocked position in which the head does operate when the pushbutton is pressed, the locked and closed positions coinciding, and the unlocked and open positions coinciding.

13. A fluid dispenser comprising a fluid reservoir (10), a dispenser member (4), and a dispenser head according to claim 1.

14. A fluid dispenser head for co-operating with a dispenser member mounted on a fluid reservoir, said head axially displaceable along an axis XX for dispensing, said head comprising a fluid duct defining an inlet end and an outlet end, said inlet end connected to an outlet of the dispenser member through a connection sleeve that extends axially along the axis XX, and said outlet end defining a dispenser orifice from which the user draws the dispensed fluid, said head further comprising closure means for selectively closing the dispenser orifice, said closure means comprising a closure member that is displaceable between a closed position in which the closure member closes the dispenser orifice, and an open position in which the fluid coming from the dispenser member can flow through the duct and the dispenser orifice, wherein the head comprises a non-rotary portion that is prevented from turning relative to the dispenser member, and a rotary portion that can be turned relative to the non-rotary portion portion about the axis XX, said head further comprising displacement means for displacing the closure member between the closed and open positions while the rotary portion is turned relative to the non-rotary portion; and the closure means comprise a connection element, and an anchor element, said connection element connecting the closure member to the anchor element; and the displacement means are engaged with the connection element, so as to cause the connection element to deform.

15. A fluid dispenser head for co-operating with a dispenser member mounted on a fluid reservoir, said head axially displaceable along an axis XX for dispensing, the head comprising:

a fluid duct defining an inlet end and an outlet end, the inlet end configured to be connected to an outlet of the dispenser member through a connection sleeve that extends axially along the axis XX, and the outlet end defining a dispenser orifice exposed directly to the outside atmosphere from which the user draws the dispensed fluid;

a closure mechanism that selectively closes the dispenser orifice and that comprises a plug displaceable between a closed position in which the plug closes the dispenser orifice and an open position in which the fluid coming from the dispenser member can flow through the duct and the dispenser orifice;

a non-rotary portion configured so as not to turn relative to the dispenser member;

a rotary portion that is configured to be turned relative to the non-rotary portion about the axis XX;

a lug that displaces the plug between the closed and open positions while the rotary portion is turned relative to the non-rotary portion;

wherein the dispenser orifice is formed by the rotary portion.

16. The fluid dispenser head according to claim 15, wherein the closure mechanism comprises a connection element and an anchor, the connection element connecting the plug to the anchor element.

17. The fluid dispenser head according to claim 16, wherein the lug engages the anchor so as to exert traction on the closure member via the connection element.

18. The fluid dispenser head according to claim 16, wherein the lug is engaged with the connection element so as to cause the connection element to deform.

19. The fluid dispenser head according to claim 16, wherein the connection element urges the plug into leaktight contact in the dispenser orifice in the closed position.

* * * * *